United States Patent [19]

Price

[11] 4,245,378

[45] Jan. 20, 1981

[54] AIR JET FOR INTERLACING MULTIFILAMENT YARN

[75] Inventor: Samuel T. Price, Kennett Square, Pa.

[73] Assignee: Enterprise Machine and Development Corp., New Castle, Del.

[21] Appl. No.: 77,798

[22] Filed: Sep. 24, 1979

[51] Int. Cl.[3] ..... D02G 1/16

[52] U.S. Cl. ..... 28/271; 28/274

[58] Field of Search ..... 28/252, 271, 272, 274, 28/275, 276

[56] References Cited

U.S. PATENT DOCUMENTS

| | | | |
|---|---|---|---|
| 3,460,213 | 8/1969 | Ensslin et al. | 28/275 |
| 3,727,275 | 4/1973 | Ohayon | 28/271 |

*Primary Examiner*—Robert Mackey

*Attorney, Agent, or Firm*—Bell, Seltzer, Park & Gibson

[57] ABSTRACT

Air jets are normally designed for interlacing a particular size or type of multifilament yarns and are not normally designed for universal use in interlacing different types and sizes of yarns. The present interlacing air jet is provided with a rotationally adjustable air directing pin (27) provided with an air passageway (26) communicatively connecting an air entry passage (20) with a yarn processing bore (11) extending through the body (10) of the air jet. An annular groove (32) is also provided in the air directing pin (27) for directing air in semicircular paths of travel around the air directing pin (27). Rotational adjustment of the air directing pin (27) provides selective variation of the angle at which the air enters the yarn processing bore (11) and engages the yarn passing therethrough so that the air jet can be used to interlace different types and sizes of yarns.

3 Claims, 5 Drawing Figures

AIR JET FOR INTERLACING MULTIFILAMENT YARN

FIELD OF THE INVENTION

This invention relates generally to an air jet for interlacing multifilament yarn and more particularly to an air jet of this type including adjustable air directing means for selectively varying the angle at which the air is directed against the yarn passing through the jet.

BACKGROUND OF THE INVENTION

It is known to use jets for texturing multifilament yarn to impart crimps, curls or loops to the yarn filaments. It is also known to use air jets for interlacing the filaments of multifilament yarns. In many cases, the air jets have been used for interlacing multiple yarn ends to eliminate the usual plying operation.

The prior known types of interlacing air jets may be divided into two general types. In one type, the air is directed against the yarn passing through the jet at an acute angle. Among the several patents disclosing this general concept is the London et al U.S. Pat. No. 3,911,655 wherein the air is directed against the yarn at an acute angle of 45° to 75° and in the direction of movement of the yarn through the air jet.

In the other type of interlacing air jet, the air is directed against the yarn at a right angle as the yarn passes through the air jet. The Pike U.S. Pat. No. 3,983,609 is representative of the second type of interlacing air jet wherein the air is directed against the yarn at a right angle as the yarn passes through the air jet.

Both of these types of interlacing air jets appear to work satisfactorily for particular yarns. However, the interlacing of particular types of yarns requires the use of an air jet of the type which directs the air against the yarn in an angular relationship, either in the direction of travel of the yarn through the air jet or opposite to the direction of travel of the yarn through the air jet. The interlacing of other types of yarns requires the use of an air jet of the type which directs the air against the yarn at a right angle. Thus, these two types of air jets of the prior art are designed to direct the air against the yarn at a particular angle, and this angle cannot be changed, except by changing from one air jet to another.

In an attempt to provide an air jet which can be used to interlace and/or texture a variety of different types and sizes of yarn, the Roberts U.S. Pat. No. 3,823,448 discloses an air jet provided with a plurality of inserts which are selectively positioned in the jet to vary the angle at which the air is directed against the yarn. However, the use of this jet requires the removal of one insert and replacement with a different type insert each time it is desired to change the angle at which the air is directed against the yarn.

SUMMARY OF THE INVENTION

With the foregoing in mind, it is an object of the present invention to provide an air jet for interlacing multifilament yarn which may be used to interlace various types and sizes of yarn and which includes means for selectively varying the angle at which the air is directed against the yarn as it passes through the air jet. To this end, the present air jet is provided with adjustable air directing means positioned between the air entry passage and the yarn processing bore so that the air may be directed against the yarn at an angle which corresponds to the direction of travel of the yarn, at an angle which is opposite to the direction of travel of the yarn, or at a right angle to the direction of travel of the yarn.

In accordance with the present invention, the adjustable air directing means for selectively varying the angle at which the air engages the yarn comprises an air directing pin supported for rotational adjustment in the air jet and an air passageway extends through the fluid directing pin. Also, the rotationally adjustable air directing pin is provided with an annular groove of substantially the same width as the diameter of the air passageway and encircles the air directing pin so that a portion of the air from the air entry passage passes through the air passageway and a portion of the air passes through the annular groove and around opposite sides of the air directing pin to subject the yarns passing through the air jet to both direct and indirect engagement of the air to thereby increase the turbulence in the yarn processing bore and enhance the interlacing of the filaments.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
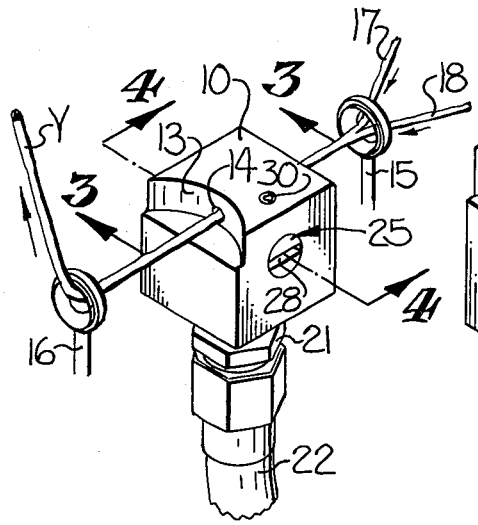
FIG. 1 is an isometric view of the air jet of the present invention and illustrating a pair of multifilament yarns being directed into and through the jet so that the filaments of the two yarns are interlaced or entangled by the air jet.
Figure 2:
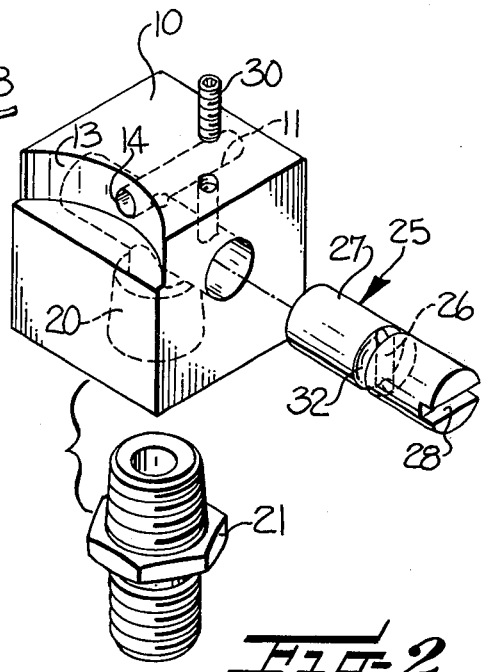
FIG. 2 is a view similar to FIG. 1 but showing the parts in exploded condition and being somewhat enlarged.

The jet of the present invention is described as being particularly adapted for directing air under pressure against the yarn as it passes through the jet, however, it is to be understood that the jet of the present invention may be used to direct other suitable types of fluid against the yarn, such as steam or the like. The jet includes a body member 10 which is illustrated as a substantially square metallic block with a yarn processing bore 11 extending through the upper portion of the body member 10 to provide a yarn entry opening 12 at one end of the body member 10. The other end of the upper portion of the block 10 is provided with an arcuate cut-away portion 13 so that the yarn processing bore 11 provides a yarn exit opening 14 in the arcuate cut-away portion 13.

Suitable yarn guides 15, 16 are provided adjacent the corresponding yarn entry opening 12 and yarn exit opening 14 to guide the yarn into and through the jet. As illustrated in FIG. 1, the yarn guide 15 directs a pair of yarns 17, 18 into the air jet and the guide 16 directs the entangled or interlaced single yarn Y outwardly from the air yet. The yarns 17, 18 are withdrawn from suitable yarn supply sources, not shown, and the interlaced yarn Y is directed to a suitable take-up, not shown.

An air entry passage 20 extends from the lower outer surface of the body member 10 inwardly toward but terminates short of the yarn processing bore 11. One end of a connector nipple 21 is threadably secured in the air entry passage 20 and the other end is connected to one end of an air supply line 22, the other end of which is connected to a source of pressurized air, not shown. Air directing means, broadly indicated at 25, is carried by the body member 10 and positioned between the fluid entry passage 20 and the yarn processing bore 11. The air directing means 25 includes a primary fluid passageway 26 communicatively connecting the air entry passage 20 and the yarn processing bore 11 so that the angle at which a primary portion of the air enters the yarn processing bore 11 can be selectively varied to interlace particular yarns in the most efficient manner. Also, the ability to selectively vary the angular direction of entry of air into the yarn processing bore 11 permits the jet to be used to treat various types and sizes of yarn.

Figure 4:
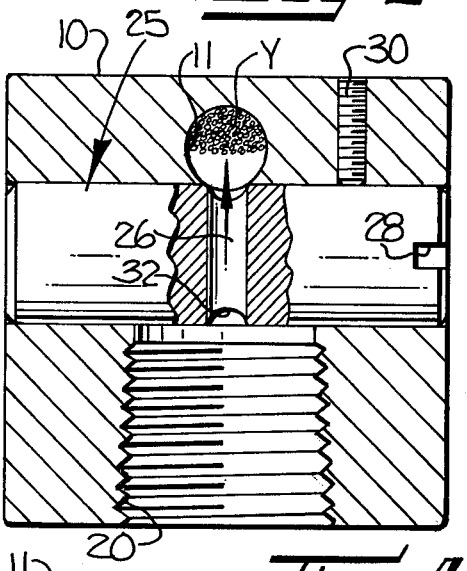
FIG. 4 is an enlarged transverse vertical sectional view through the air jet, being taken substantially along the line 4—4 in FIG. 1.

The fluid directing means 25 is illustrated in the form of an air directing pin 27 having opposite ends extending outwardly and terminating substantially flush with opposite sides of the body member 10. The air directing pin 27 is supported for rotational adjustment in a bore extending through the body member 11 and the primary air passageway 26 extends through the air directing pin 27. One end of the air directing pin 27 is provided with a slot 28 which is preferably positioned at right angles to the air passageway 26 and into which a screwdriver may be inserted for rotating the pin 27 to the desired position. A set screw 30 is threadably embedded in the body member 10 and its lower end is adapted to engage the upper portion of the air directing pin 27 for maintaining the same in adjusted position (FIG. 4).

The fluid directing means 25 also includes a secondary air entry passageway in the form of an annular groove 32 of substantially the same width as the diameter of the primary air passageway 26 and encircling the air directing pin 27. Thus, when air under pressure enters the fluid entry passage 20, a portion of the air passes directly through the air passageway 26 in the air directing pin 27 and directly against the yarns passing through the yarn processing bore 11. A portion of the air from the entry passage 20 also passes around opposite sides of the pin 27 and through the annular groove 32, in the manner indicated by the arrows in FIG. 3. It may be said that the yarn passing through the bore 11 is thereby subjected to both direct and indirect engagement from the air and that additional air turbulence is created in the bore 11 to enhance the entanglement or interlacing of the filaments of the yarns passing through the jet.

Figure 3:
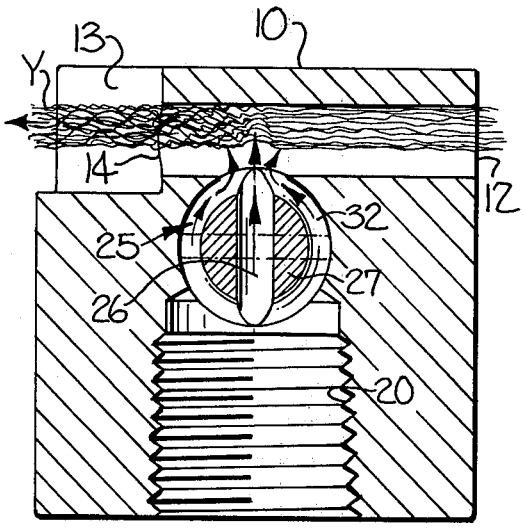
FIG. 3 is an enlarged longitudinal vertical section through the air jet, being taken substantially along the line 3—3 in FIG. 1.

The air entering the bore 11 through the passageway 26 is directed upwardly and against the lower surface of the yarns in the bore 11 and appears to force the yarns to the upper portion of the bore 11, as shown in FIG. 3. The air entering the bore 11 from the annular groove 32 is also initially directed upwardly and may create oppositely rotating vortexes of air in advance of and following the upward path of the air from the passageway 26. If this action does take place, areas of reduced pressure may be created on opposite sides of the upwardly directed air and at least some of the filaments of the yarns would be drawn downwardly in the bore 11. These opposite forces successively applied to the yarns as they pass through the bore 11 may explain the enhanced interlacing of the yarns.

Figure 5:
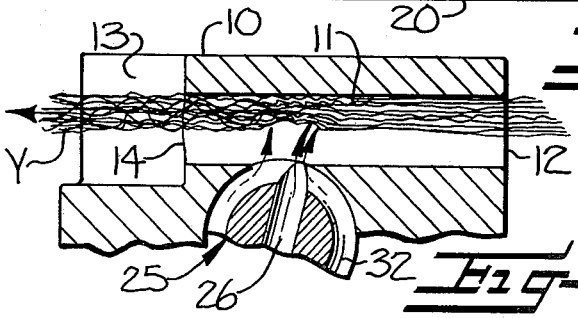
FIG. 5 is a vertical sectional view similar to the upper portion of FIG. 3 but showing the air directing pin being rotated in a clockwise direction to direct the air against the yarn at an angle which is reverse to the direction of movement of the yarn through the air jet.

With the air directing pin 27 positioned as shown in FIG. 3, the air is directed primarily through the passageway 26 at a right angle to the path of travel of the yarn through the bore 11. The air directing pin 27 may be rotated from the position shown in FIG. 3 and either in a counterclockwise position or in a clockwise position, as shown in FIG. 5, so that the primary direction of air passing through the air passageway 26 is directed against the yarn at an angle which is the same as or opposite to the direction of travel of the yarns passing through the bore 11.

While the dimensions of the various parts of the present air jet may be varied, it has been found that satisfactory results can be obtained in the interlacing of the filaments of a variety of different types and sizes of multifilament yarns when the air jet is substantially square and the outside dimensions of the body member 10, that is, length, height and width, are each 0.75 of an inch. The yarn processing bore 11 extending through the body member 10 is 0.125 of an inch in diameter and the air directing pin 27 is 0.25 of an inch in diameter. The air passageway 26 in the air directing pin 27 is 0.062 of an inch. The annular groove 32 extending around the air directing pin 27 is of the same width as the fluid passageway 26 and has a radius of 0.031 of an inch.

The air jet of the present invention provides means for selectively varying the angle at which the air is directed against the yarn passing through the jet to thereby obtain the most efficient interlacing of the filaments and to enable the present air jet to be used to interlace various types and sizes of yarn. Also, the present jet provides a primary air passageway and a secondary air passageway with the primary air passageway directing the air in a straight line and directly against the yarn while the secondary air passageway causes the air to travel opposite semi-circular paths of travel and may be said to indirectly engage the yarn so that the yarn is subjected to both direct and indirect engagement by the air.

In the drawings and specification there has been set forth the best mode presently contemplated for the practice of the invention, and although specific terms are employed, they are used in a generic and descriptive sense only and not for purposes of limitation, the scope of the invention being defined in the claims.

I claim:

1. An air jet for interlacing yarns comprising a body member, a yarn processing bore extending through said body member and providing a yarn entry opening at one end of said body member and a yarn exit opening at the other end of said body member so that yarn may be passed through said bore of said air jet, an air entry passage extending from the outer surface of said body member and inwardly toward but terminating short of said yarn processing bore, and adjustable air directing means carried by said body member and positioned between said air entry passage and adjacent one side of said yarn processing bore, said air directing means comprising an air directing pin supported for rotational adjustment in said body member and about an axis disposed perpendicular to the axis of said yarn processing bore, and wherein said air passageway extends through said air directing pin, said air directing pin being supported for rotational adjustment adjacent one side of said yarn processing bore with said air passageway communicatively connecting said air entry passage with one side of said yarn processing bore so that said air passgeway may be positioned to direct the air against the yarn in perpendicular, upstream or downstream directions.

2. An air jet according to claim 1 wherein said air directing pin includes opposite ends extending outwardly and terminating substantially flush with opposite sides of said body member, one end of said air directing pin being provided with a slot for adjusting the rotational angular relationship of said air directing pin to vary the angle at which the air enters said yarn processing bore, and means carried by said body member for engagement with said air directing pin to maintain the same in adjusted position.

3. An air jet according to claim 1 or 2 and including an annular groove of substantially the same width as the diameter of said air passageway and encircling said air directing pin, said annular groove being aligned with said air passageway so that a portion of the air from said air entry passage passes through said air passageway and into said yarn processing bore and a portion of the air passes around opposite sides of said air directing pin and into said yarn processing bore.

* * * * *